US006703815B2

(12) United States Patent
Biagi

(10) Patent No.: US 6,703,815 B2
(45) Date of Patent: Mar. 9, 2004

(54) LOW DROP-OUT REGULATOR HAVING CURRENT FEEDBACK AMPLIFIER AND COMPOSITE FEEDBACK LOOP

(75) Inventor: Hubert J. Biagi, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/151,366

(22) Filed: May 20, 2002

(65) Prior Publication Data

US 2003/0214275 A1 Nov. 20, 2003

(51) Int. Cl.[7] ..... G05F 1/40
(52) U.S. Cl. ..... 323/280; 323/281; 323/275
(58) Field of Search ..... 323/280, 281, 323/274, 275, 277; 327/465, 553, 554, 555

(56) References Cited

U.S. PATENT DOCUMENTS 5,191,278 A * 3/1993 Carpenter ..... 323/275
5,365,161 A 11/1994 Inoue et al.
5,559,424 A * 9/1996 Wrathall et al. ..... 323/277
5,563,501 A 10/1996 Chan
5,861,736 A * 1/1999 Corsi et al. ..... 323/273
6,246,221 B1 * 6/2001 Xi ..... 323/280
6,465,994 B1 * 10/2002 Xi ..... 323/274
6,483,727 B2 * 11/2002 Oki et al. ..... 363/39
6,518,737 B1 * 2/2003 Stanescu et al. ..... 323/280
6,522,112 B1 * 2/2003 Schmoock et al. ..... 323/280

FOREIGN PATENT DOCUMENTS

EP 0957421 A2 11/1999
EP 1253498 A1 10/2002

* cited by examiner

*Primary Examiner*—Shawn Riley
(74) *Attorney, Agent, or Firm*—W. Daniel Swayze, Jr.; W. James Brady; Frederick J. Telecky, Jr.

(57) ABSTRACT

A low drop-out regulator is configured to provide high output current with a fast response during transient conditions, while also maintaining low quiescent current under DC conditions. An exemplary low drop-out regulator has an error amplifier, a current feedback amplifier, and a pass device. The low drop-out regulator includes a composite amplifier feedback configuration, with the current feedback amplifier being decoupled from the overall composite feedback configuration and configured to provide effective compensation. As a result, the current feedback amplifier can be configured to operate with low current supplied from the error amplifier and to drive the control terminal of the pass device with sufficiently high current as demanded by a load device. In addition, the current feedback amplifier can be configured to permit the voltage at the control terminal of the pass device to operate from rail-to-rail. Further, the gain and offset of the low drop-out regulator can be provided by the error amplifier, without the requirement to drive a high amount of current.

27 Claims, 3 Drawing Sheets

LOW DROP-OUT REGULATOR HAVING CURRENT FEEDBACK AMPLIFIER AND COMPOSITE FEEDBACK LOOP

FIELD OF THE INVENTION

The present invention relates to power supply circuits. More particularly, the present invention relates to a low drop-out regulator having composite amplifier configured to provide a higher performance power supply circuit.

BACKGROUND OF THE INVENTION

The increasing demand for higher performance power supply circuits has resulted in the continued development of voltage regulator devices. Many low voltage applications are now requiring the use of low dropout (LDO) regulators, such as for use in cellular phones, pagers, laptops, camera recorders and other mobile battery operated devices. These portable electronics applications typically require low voltage and quiescent current flow to facilitate increased battery efficiency and longevity. The alternative to low drop-out regulators are switching regulators which operate as dc-dc converters. Switching regulators, though similar in function, are not preferred to low drop-out regulators in many applications because switching regulators are inherently more complex and costly, i.e., switching regulators can have higher cost, as well as increased complexity and output noise than low drop-out regulators.

Low drop-out regulators generally provide a well-specified and stable dc voltage whose input to output voltage difference is low. Low drop-out regulators typically have an error amplifier in series with a pass device, e.g., a power transistor, which is connected in series between the input and the output terminals of the low drop-out regulator. The error amplifier is configured to drive the pass device, which can then drive an output load. The operation of the low drop-out regulator is based on a control loop, which includes the feeding back of an amplified error signal used to control the output current flow of the power transistor driving the output load. The drop-out voltage of the low drop-out regulator is defined as the value of the input/output differential voltage that the control loop stops regulating. Low drop-out regulator 100 also typically requires large output capacitors that are required to have a low electrical series resistance (ESR). However, such capacitors tend to require large circuit board area, and thus are highly responsible for the overall cost of the low drop-out regulator.

Such a low drop-out regulator generally has two inherent characteristics including the magnitude of the input voltage being greater than the respective output voltage, and the output impedance being low so as to yield good performance. Low drop-out regulators can also typically be categorized as either low power or high power. Low power low drop-out regulators generally have a maximum output current of less than 1 A, and are used mainly by the above portable applications. On the other hand, high power low drop-out regulators can yield currents that are equal to or greater than 1 A at the output, which can be demanded by many automotive and industrial applications.

With reference to FIG. 1, a schematic diagram of a conventional low drop-out regulator 100 is illustrated. Low drop-out regulator 100 includes an error amplifier 102 and a pass device 104 configured in a feedback arrangement. Error amplifier 102 is configured to drive a low current during DC conditions, and a high current, e.g., 1 mA, under high slew or transient conditions. Error amplifier typically includes a class AB-type amplifier device. Error amplifier 102 has a positive input connected to a reference voltage $V_{REF}$, and powered by an input supply voltage $V_{IN}$. Reference voltage $V_{REF}$, which usually includes a zener diode for high voltage applications or a bandgap reference for low voltage and high accuracy applications, is configured to provide a stable dc bias voltage with limited current driving capabilities.

Pass device 104 comprises a power transistor device $M_P$ configured for driving an output current $I_{OUT}$ to a load device. Pass device 104 has a control terminal suitably coupled to the output of error amplifier 102 and can include various configurations, such as NPN follower, NMOS follower, or common emitter PNP or common source PMOS transistors. Bipolar devices are generally used for applications requiring higher output currents and are capable of generating higher quiescent currents, while MOS devices are generally used for applications requiring minimized quiescent current. For bipolar devices, the beta $\beta$ is defined as the ratio of the collector current to base current. This base current can be large and is often driven into ground, i.e., the ground current is increased considerably. For a low drop-out regulator, beta is also a measure of the efficiency, i.e., the ratio of the output current $I_{OUT}$ to the ground current. Because the bipolar device is considered a current gain device, the beta $\beta$ can be quite low, ranging approximately from 100 to 1000. Thus, for every milliamp of current delivered at the output $I_{OUT}$, 1 $\mu$A to 10 $\mu$A would be delivered to ground, i.e., for 100 mA of output current, between 100 $\mu$A and 1000 $\mu$A of ground current are realized, resulting in poor efficiency for such bipolar devices.

Accordingly, CMOS transistor pass devices are usually the best overall configuration for optimizing efficiency. In the example of FIG. 1, pass device 104 includes a PMOS transistor device, which typically requires very low DC current under full load conditions. Pass device 104 receives at a control terminal, e.g., gate terminal, an amplified error signal from error amplifier 102 configured to control the output current flow of pass device 104 when driving the output load at an output terminal $V_{OUT}$. Pass device 104 is configured to feed back the error signal to error amplifier 102.

Pass device 104 also introduces large, parasitic capacitances $C_1$ and $C_2$ to low drop-out regulator 100. The large capacitances, for example 100 pF or more, can limit the capability of error amplifier 102, since the capacitances require high current during a fast transition. For example, when designing devices configured to respond rapidly to changes in the output load, pass device 104 requires a large amount of current since parasitic capacitances $C_1$ and $C_2$ must be charged and discharged. Thus, in transient conditions, milliamps of current during microsecond periods must be supplied by error amplifier 102 just to charge parasitic capacitances $C_1$ and $C_2$.

In addition to the requirement for higher current during transient conditions, other constraints are present on error amplifier 102. For example, as currently available power systems are demanding the use of less operating supply voltage $V_{IN}$, such as an operating voltage of 1.8 volts, low drop-out regulator has to operate within one gate-source voltage $V_{GS}$, or approximately within a threshold voltage $V_T$ of the pass device plus an extra voltage $\Delta$. Thus for a single gate-source voltage $V_{GS}$ topology, to turn on pass device 104 with a threshold voltage $V_T$ of 0.7 to 1.2 volts, error amplifier 102 must provide at least that voltage plus the extra voltage $\Delta$, all within the limited headroom of 1.8 volts.

Another constraint on error amplifier 102 is the need to control the offset of the low drop-out regulator. In other words, not only does error amplifier 102 need to comprise a class AB device that can drive a lot of output current, while also providing a low quiescent current during low voltages, error amplifier 102 also needs to minimize the offset contribution.

Yet another constraint of error amplifier 102 is the compensation requirement. As discussed above, pass device 104 includes large parasitic capacitances, thus often requiring the implementation of a buffer, or a $g_m$ boost, to isolate the high output resistance of the gain stage of error amplifier 102 from the high load capacitance of pass device 104. For example, with reference to FIG. 2, a low drop-out regulator 200 implementing a buffer 206 between the output of an error amplifier 202 and a pass device 204 is illustrated. Buffer 206 is configured to receive the output current from error amplifier 202 and drive the gate of pass device 204. The output from buffer 206 can be mirrored back through a complex, current mirror circuit including transistors $M_1$ through $M_5$ to compensate error amplifier 202. Other schemes can further incorporate an additional operational amplifier at the output of the pass device to sense the output current. However, adding such additional components can create stability problems. In addition, low drop-out regulator 200 generally has a lower efficiency due to a higher ground current, i.e., the current mirror circuit including transistors $M_1$ through $M_5$ tends to drive current to ground.

In some applications, with reference to a low drop-out regulator 300 illustrated in FIG. 3, a buffer 306 can includes a bipolar follower configuration, which is biased in class A operation. However, in either compensation scheme, current is being taken from the supply and driven into ground, i.e., the ground current is increased considerably, resulting in reduced efficiency.

In addition, for bipolar buffer configurations, headroom limitations are often readily apparent. For example, to buffer error amplifier 302 and to drive pass device 304, NPN follower device 306 needs to be at least a base-emitter voltage $V_{BE}$ above the drive voltage, i.e., level shifting of the voltage at the gate of pass device 304 is necessary. Thus, for a drive voltage of 0.8 volt needed to drive the gate of pass device 304, and with a base-emitter voltage $V_{BE}$ of 0.8 to 1.0 volt, very little headroom is available for lower voltage power supply circuits, such as those with supply voltages $V_{IN}$ of 1.8 volts. As a result, control of pass device 304 can be difficult.

Accordingly, a need exists for a low drop-out regulator that provides higher performance and efficiency, and that can overcome the various problems with prior art low drop-out regulators.

SUMMARY OF THE INVENTION

The method and circuit according to the present invention addresses many of the shortcomings of the prior art. In accordance with various aspects of the present invention, a low drop-out regulator is configured to provide high output current with a fast response during transient conditions, while also maintaining low quiescent current under DC conditions.

In accordance with an exemplary embodiment, an exemplary low drop-out regulator comprises an error amplifier, a current feedback amplifier, and a pass device. The low drop-out regulator includes a composite amplifier feedback configuration, with the current feedback amplifier being decoupled from the overall composite feedback configuration and configured to provide effective compensation. As a result, the current feedback amplifier can be configured to operate with low current supplied from the error amplifier and to drive the control terminal of the pass device with sufficiently high current as demanded by a load device.

In accordance with another aspect of the present invention, the current feedback amplifier can be configured to permit the voltage at the control terminal of the pass device to operate from rail-to-rail. In accordance with an exemplary embodiment, instead of providing the feedback and reference signals into the high impedance control terminals of a pair of input devices, the current feedback amplifier is configured with a feedback and/or reference signal being provided to the low impedance input terminals of a pair of input devices. As a result, current is forced through the pair of input devices and can be suitably utilized to supply the low drop-out regulator with the ability to provide rail-to-rail output drive capabilities from an output device of the current feedback amplifier to the pass device.

In accordance with another aspect of the present invention, the gain and offset of the low drop-out regulator can be provided by the error amplifier, without the requirement to drive a high amount of current to the current feedback amplifier.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

The present invention may be described herein in terms of various functional components and various processing steps. It should be appreciated that such functional components may be realized by any number of hardware or structural components configured to perform the specified functions. For example, the present invention may employ various integrated components, such as buffers, current mirrors, and logic devices comprised of various electrical devices, e.g., resistors, transistors, capacitors, diodes and the like, whose values may be suitably configured for various intended purposes. In addition, the present invention may be practiced in any integrated circuit application. However for purposes of illustration only, exemplary embodiments of the present invention will be described herein in connection with a low drop-out regulator for use with power supply circuits.

Further, it should be noted that while various components may be suitably coupled or connected to other components within exemplary circuits, such connections and couplings can be realized by direct connection between components, or by connection through other components and devices located thereinbetween.

As discussed above, prior art low drop-out regulators have difficulty in maintaining low quiescent current flow, as well as in controlling offset contributions. Further, prior art low drop-out regulators utilize complex compensation schemes, and have difficulty controlling the pass device when limited headroom is available. However, in accordance with various aspects of the present invention, a low drop-out regulator is configured to provide high output current with a fast response during transient conditions, while also maintaining low quiescent current.

In accordance with an exemplary embodiment, an exemplary low drop-out regulator comprises an error amplifier, a current feedback amplifier, and a pass device. The low drop-out regulator includes a composite amplifier feedback configuration, with the current feedback amplifier being decoupled from the overall composite feedback configuration. As a result, the current feedback amplifier can be configured to operate with low current supplied from the error amplifier and to drive the gate of the pass device with sufficiently high current as demanded by a load device.

Figure 1:
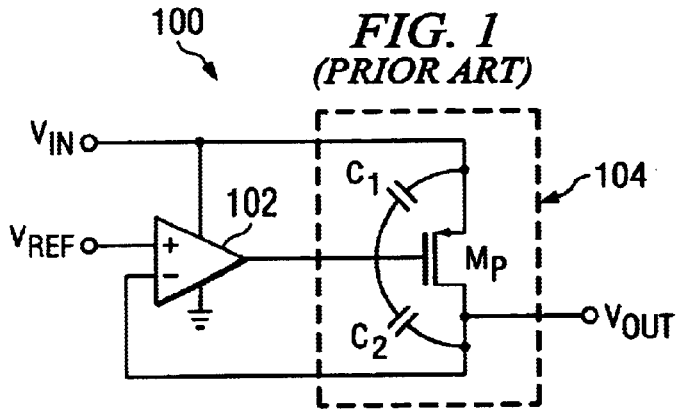
FIG. 1 (PRIOR ART)
FIG. 1 illustrates a block diagram of a prior art low drop-out regulator.
Figure 2:
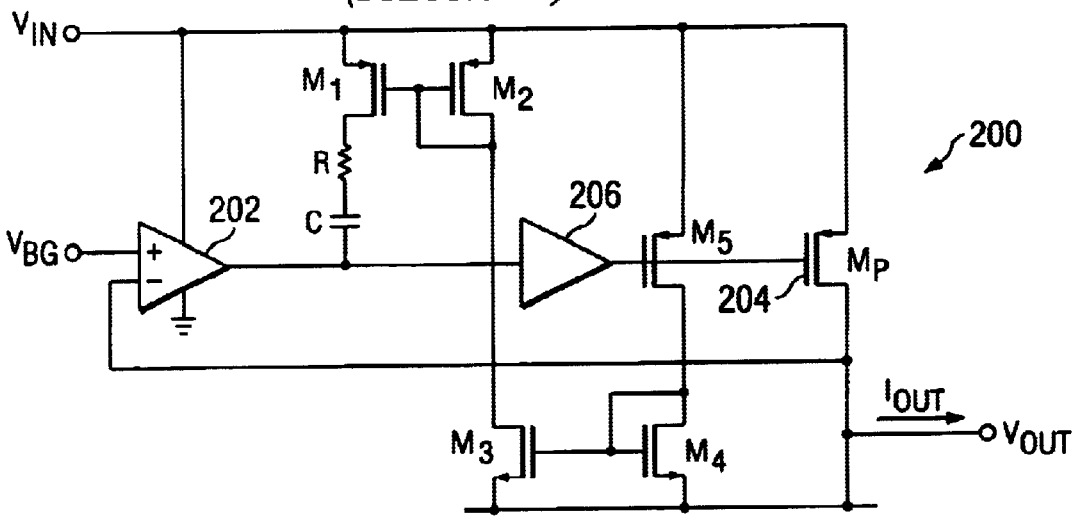
FIG. 2 (PRIOR ART)
FIG. 2 illustrates a block diagram of a prior art low drop-out regulator incorporating a buffer configuration.
Figure 3:
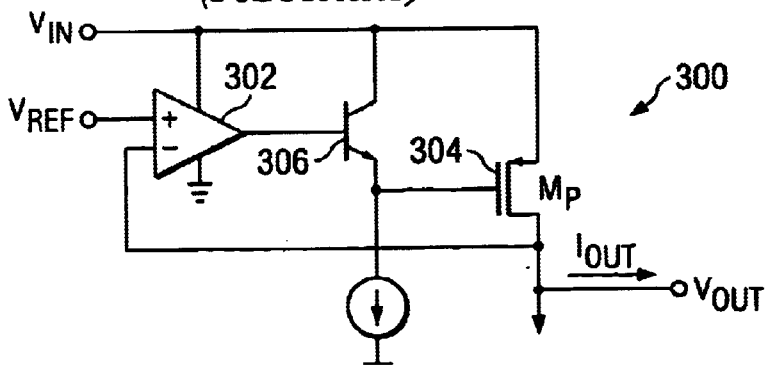
FIG. 3 (PRIOR ART)
FIG. 3 illustrates a block diagram of another prior art low drop-out regulator incorporating a NPN follower.
Figure 4:
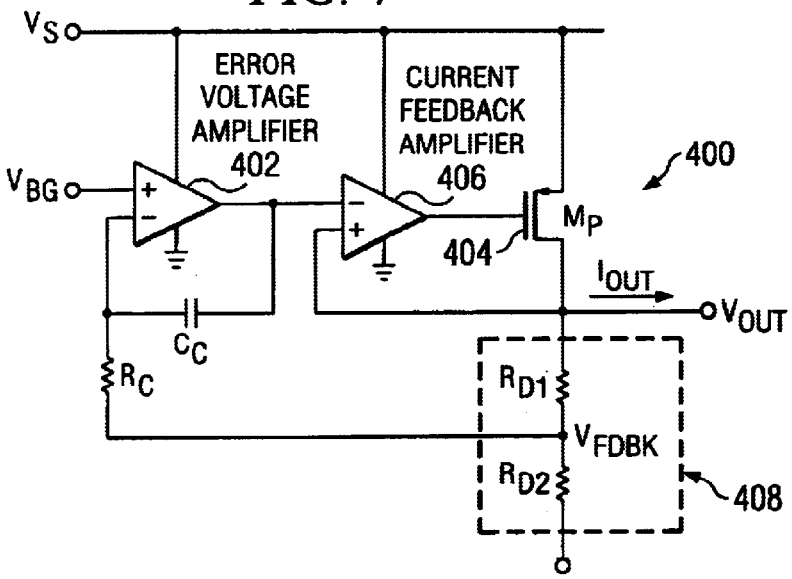
FIG. 4 illustrates a block diagram of a low drop-out regulator in accordance with an exemplary embodiment of the present invention.

With reference to FIG. 4, an exemplary low drop-out regulator 400 in accordance with an exemplary embodiment of the present invention is illustrated. Low drop-out regulator 400 suitably comprises an error amplifier 402, a pass device 404, a current feedback amplifier 406, and a divider network 408. Low drop-out regulator 400 includes a composite amplifier feedback configuration, with the feedback loop of current feedback amplifier 406 being decoupled from the overall composite feedback loop, and with current feedback amplifier 406 being configured to provide effective compensation.

In accordance with the exemplary embodiment, error amplifier 402 suitably includes a class A device configured to control the gain and offset of low drop-out regulator 400. Error amplifier 402 includes a non-inverting input terminal configured to receive a reference voltage, such as a bandgap reference voltage $V_{BG}$, and a negative input terminal configured to receive a composite feedback signal from resistor network 408 through a resistor device $R_C$. In addition, a capacitor $C_C$ is coupled from the output of error amplifier 402 to the negative input terminal of error amplifier 402. Capacitor $C_C$ can also be configured to supply additional current to the input of current feedback amplifier 406 to facilitate the driving of the control terminal of pass device 404 during transient conditions, e.g., for driving of the control terminal of pass device 404 to ground when the output voltage at output terminal $V_{OUT}$ is pulled down. As will be discussed further below, error amplifier 402 is not required to drive a large amount of current to operate current feedback amplifier 406.

Current feedback amplifier 406 is configured to operate with low current from error amplifier 402 and to suitably drive the control terminal of pass device 404. In the exemplary embodiment, current feedback amplifier 406 is configured to receive an output signal from error amplifier 402 at an inverting input terminal. Current feedback amplifier also includes a unity gain buffer configured with pass device 404 and a local feedback loop coupled from an output of pass device 404 to a non-inverting input terminal, i.e., a current feedback loop decoupled from the composite amplifier loop. As discussed further below, current feedback amplifier 406 can be configured in various circuit arrangements for driving pass device 404.

Pass device 404 includes a power transistor device configured for driving an output current $I_{OUT}$ to a load device. In the exemplary embodiment, pass device 404 includes a PMOS transistor device having a source coupled to a supply voltage rail $V_S$, a drain coupled to a output voltage terminal $V_{OUT}$, and a control terminal, i.e., a gate, coupled to the output of current feedback amplifier 406. However, pass device can include any power transistor configuration, such as NPN or NMOS follower transistors, or any other transistor configuration for driving output current $I_{OUT}$ to a load device. Pass device 404 is configured to source as much current as needed by the load device and/or divider network 408.

Divider network 408 suitably includes a resistive divider configured for providing a composite feedback signal. In the exemplary embodiment, divider network 408 includes a pair of resistors $R_{D1}$ and $R_{D2}$. Resistor $R_{D1}$ is coupled between pass device 404 and resistor $R_{D2}$, while resistor $R_{D2}$ is connected to ground. A composite feedback signal can be provided from a node $V_{FDBK}$ configured between resistors $R_{D1}$ and $R_{D2}$, through resistor $R_C$ to the inverting input terminal of error amplifier 402.

During operation, under normal DC conditions where the output current $I_{OUT}$ at output terminal $V_{OUT}$ is in a steady state, error amplifier 402 is configured to provide an output voltage equal to the voltage at output voltage terminal $V_{OUT}$, and a low output current, to the inverting input terminal of current feedback amplifier 406. When a transient event occurs at the output load, e.g., an increase or decrease in output current $I_{OUT}$ demanded by the output load, current feedback amplifier 406 is configured to provide a high output current to drive pass device 404, while only receiving a low input current from error amplifier 402 and a high transient current provided by capacitor $C_C$.

Figure 5:
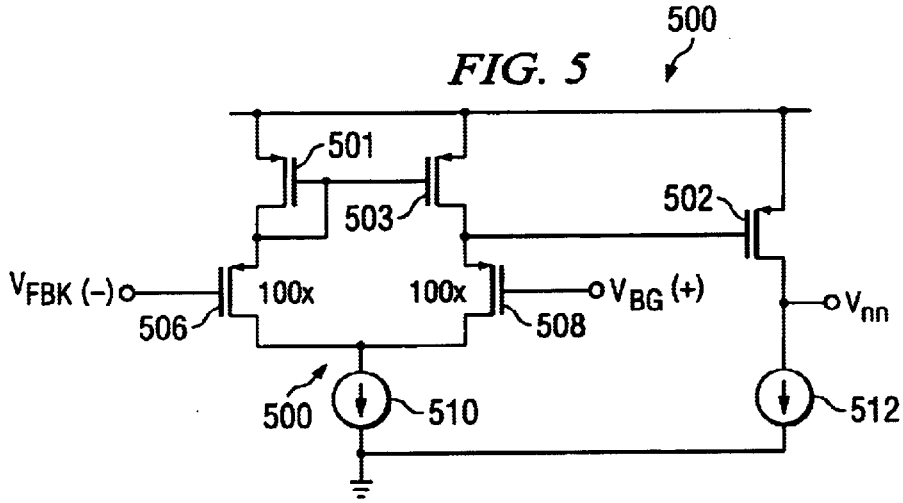
FIG. 5 illustrates a schematic diagram of an exemplary embodiment of an error amplifier in accordance with the present invention.

In accordance with another aspect of the present invention, the current error amplifier can be configured to permit the voltage at the control terminal of the pass device, e.g., the gate voltage of a PMOS transistor device $M_P$, to operate from rail-to-rail. To understand the operation of the error amplifier, an illustration of a basic error amplifier 500 for driving an output device 502 is illustrated in FIG. 5. In error amplifier 500, when utilizing a high impedance input configuration, a bandgap reference voltage $V_{BG}$ and feedback voltage $V_{FDBK}$ will appear to be present at the gate terminals of a pair of PMOS transistor devices 506 and 508. Each of PMOS devices 506 and 508, as well as output device 502 include large, parasitic capacitances that need to be charged to facilitate driving of current through a current mirror comprising transistor 501 and 503 to the gate of pass device 502. In addition, each of PMOS devices 506 and 508, as well as pass device 502 are configured as large transistor devices, such as 10× devices. However, the large capacitances tend to limit the amount of current that can be driven on the output. Further, the amount of output current that can be driven is also limited by a current source 512 configured at the drain of PMOS device 502.

However, in accordance with an exemplary embodiment, instead of providing the feedback and reference signals into the high impedance gates of a pair of input devices, a current feedback amplifier is configured with a feedback and/or reference signal being provided to the low impedance source terminals of a pair of input devices. As a result, current is forced through the pair of input devices and can be suitably utilized to supply the low drop-out regulator with the ability to provide fast, rail-to-rail output drive capabilities from an output device of the current feedback amplifier to the pass device.

Figure 6:
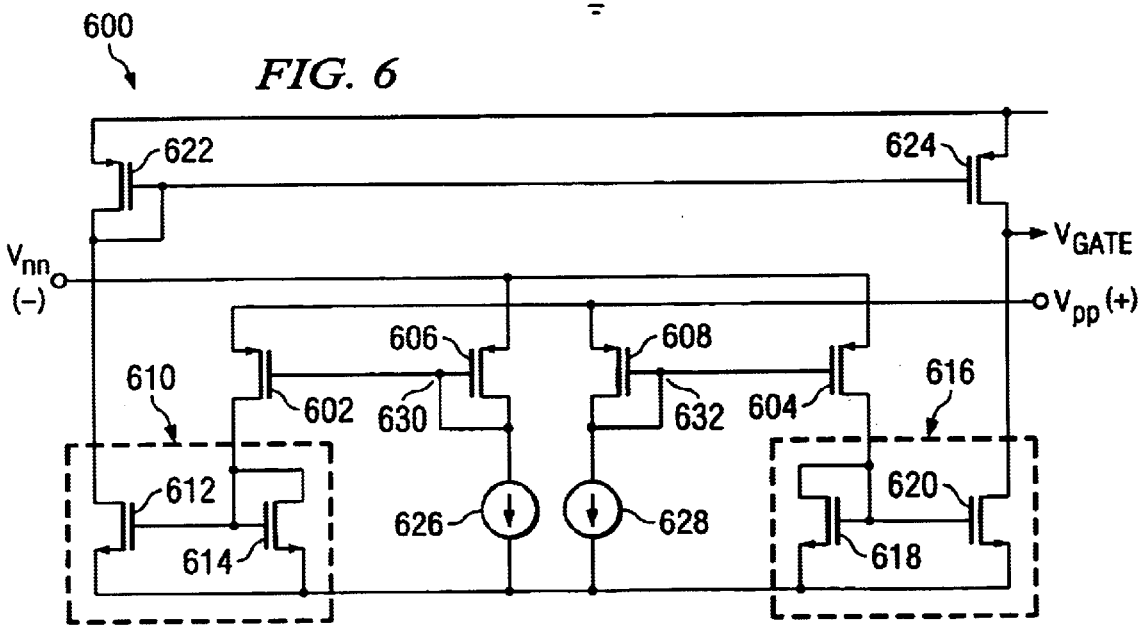
FIG. 6 illustrates a schematic diagram of an exemplary embodiment of a current feedback amplifier in accordance with the present invention.

For example, with reference to FIG. 6, an exemplary current feedback amplifier 600 in accordance with an exemplary embodiment of the present invention is illustrated. Current feedback amplifier 600 is configured to provide a fast response while also being configured to drive large amounts of current to a pass device. In addition, current feedback amplifier 600 can facilitate rail-to-rail operation of the gate of the pass device. Current feedback amplifier 600 suitably comprises a pair of input transistor devices 602 and 604, a pair of diode connected devices 606 and 608, a pair of lower current mirrors 610 and 616, a pair of current sources 626 and 628, and upper rail current mirror 620.

Input transistor devices 602 and 604 are configured for receiving input current signals, such as from voltage terminals $V_{PP}(+)$ and $V_{NN}(-)$, at their sources, respectively, with the source of input transistor device 602 including the positive or non-inverting input terminal and the source of input transistor device 604 including the negative or inverting input terminal of current feedback amplifier 600. In accordance with the exemplary embodiment, the source of input transistor device 602 can be coupled to the output of the pass device in a feedback arrangement, and the source of input transistor device 604 can be coupled to the output of the error amplifier. Input device 602 has a gate coupled to a gate of a diode-connected transistor device 606, while input device 604 has a gate coupled to a gate of a diode-connected transistor device 608. In addition, input device 602 has a drain coupled to current mirror 610, while input device 604 has a drain coupled to current mirror 616.

Diode-connected devices 606 and 608 are configured to facilitate control of the flow of current through input devices 602 and 604. Diode-connected devices 606 and 608 are configured to control the gates of input devices 602 and 604 in a fixed manner such that any current flowing input current signals, such as from voltage terminals $V_{PP}(+)$ and $V_{NN}(-)$, will be directed through input devices 602 and 604, respectively. Diode-connected device 606 has a source coupled to input voltage signal $V_{NN}(-)$ similar to the connection of the source of input device 604, and a drain coupled to ground through a current source 626, while diode-connected device 608 has a source coupled to input voltage signal $V_{PP}(+)$ similar to the connection of the source of input device 602, and a drain coupled to ground through a current source 628. While diode-connected devices 606 and 608 can be configured at approximately the same transistor device size as input devices 602 and 604, in accordance with the exemplary embodiment, input devices 602 and 604 are approximately two times the transistor size of devices 606 and 608.

Current sources 626 and 628 are configured to provide a fixed current flowing through diode-connected devices 606 and 608, and can include various current source configurations. Current sources 626 and 628 are configured to operate with a low current, for example, approximately 2 $\mu$A of current, which can flow through diode-connected devices 606 and 608. This low amount of current flowing through diode-connected devices 606 and 608 operates to hold input devices 602 and 604 at a low queue current, i.e., under DC conditions. For example, in accordance with the exemplary embodiment, with diode-connected devices 606 and 608 operating with 2 $\mu$A of current, input devices 602 and 604 can realize 4 $\mu$A of current flowing through each under DC conditions.

Current mirrors 610 and 616 are configured to mirror the current flowing through transistors 602 and 604, and provide the mirrored current to upper rail current mirror 620, a diode-connected transistor 622 and an upper output device 624 configured at the upper rail of current feedback amplifier 600. Current mirror 610 includes a diode-connected transistor 614 having a drain coupled to input device 602, and a transistor 612 having a gate coupled to a gate of transistor 614, and a drain coupled to upper transistor 622. Likewise, current mirror 616 includes a diode-connected transistor 618 having a drain coupled to input device 604, and a lower output device 620 having a gate coupled to a gate of transistor 618, and a drain coupled to upper output device 624.

Upper rail transistors 622 and 624 are configured to provide an output current to the pass device of the low drop-out regulator. Diode-connected transistor 622 is configured to suitably mirror any current received from current mirror 610 to the control terminal of the pass device through the drain of transistor 624, which includes the upper output device for current feedback amplifier 600. In accordance with an exemplary embodiment, upper output device 624 is approximately four times the transistor size of upper rail transistor 622, e.g., an 8× device size for output device 624 and a 2× device size for transistor 622. Lower output device 620 is also sized approximately four times the transistor size of lower rail transistor 618.

Accordingly, current feedback amplifier 600 is configured to operate with a very low queue current in input devices 602 and 604 under DC conditions. However, instead of providing additional current received from a feedback signal directly to ground, such as that of error amplifier 500, current feedback amplifier 600 can supply additional current through the output devices 622 and 624 to a pass device under slewing conditions, i.e., when the output load requires additional current during transitions.

Figure 7:
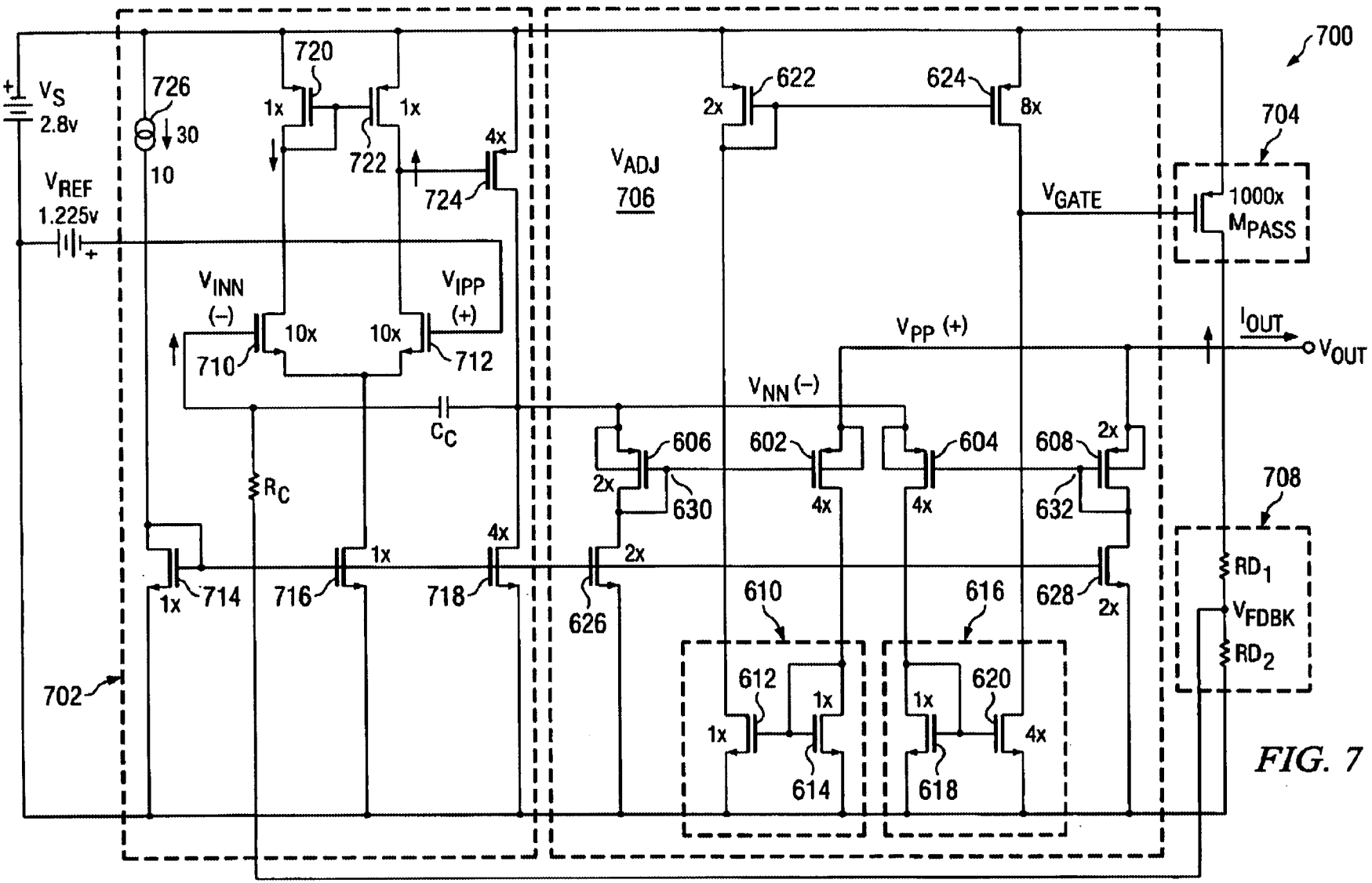
FIG. 7 illustrates a schematic diagram of an exemplary embodiment of a low dropout regulator in accordance with the present invention.

Having described the configuration and operation of an exemplary current feedback amplifier, an implementation of an exemplary current feedback amplifier within a low drop-out regulator can be provided. With reference to FIG. 7, an exemplary low drop-out regulator 700 is illustrated in accordance with an exemplary embodiment of the present invention. Low drop-out regulator 700 comprises an error amplifier 702, a pass device 704, a current feedback amplifier 706, and a divider network 708. Low drop-out regulator 700 is suitably configured with a composite feedback loop, with the feedback loop of current feedback amplifier 706 being decoupled from the overall composite feedback loop.

In accordance with this exemplary embodiment, error amplifier 702 suitably includes a class A device configured to control the gain and offset of low drop-out regulator 700. Error amplifier 702 includes a differential pair of transistors 710 and 712, a current source circuit 726, and an output device 724. Transistor 712 has a gate configured as a positive input terminal coupled to a reference voltage $V_{REF}$, such as a bandgap reference voltage, e.g., a bandgap voltage of approximately 1.2 volts. Transistor 710 has a gate configured as a negative input terminal configured to receive a composite feedback signal from resistor network 708. Source terminals of transistors 710 and 712 are connected together within the differential pair configuration, and are coupled to a current source 716. Drains of differential pair of transistors 710 and 712 can be coupled to a gate of output transistor 724 through a current mirror including transistors 720 and 722. In the exemplary embodiment, output current from input transistor 710 can be suitably mirrored through diode-connected transistor 720 and transistor 722 to the gate of output transistor 724, while output current from input transistor 712 can be directly connected to drive the gate of output transistor 724.

A composite amplifier feedback loop can be provided from divider network 708 through a resistor device $R_C$ to the negative terminal of error amplifier 702, i.e., to the gate of input transistor 710. Resistor device $R_C$ can comprise various resistance values to effectively vary the compensation to error amplifier 702. In addition, error amplifier 702 can include a capacitor $C_C$ coupled between the negative terminal of error amplifier 702, i.e., to the gate of input transistor 710, and the drain of output device 724 to suitably supply additional current to facilitate the driving of the gate of pass device 704 during transient conditions, e.g., for driving of the gate of pass device 704 to ground when the output voltage at output terminal $V_{OUT}$ is pulled down. Capacitor $C_C$ can vary in capacitance level between approximately 10 pF to 100 pF, with the higher the value of capacitance, the lower the value of resistance of resistor $R_C$. In accordance with an exemplary embodiment, resistor device $R_C$ can comprise an active variance device, while capacitor $C_C$ includes a fixed capacitance of approximately 20 pF.

A supply voltage $V_S$ is suitably configured to supply voltage to the upper supply rail. Supply voltage $V_S$ can comprise various levels of supply voltage, such as 2.8 volts, that provides additional headroom. However, supply voltage $V_S$ can also include a significantly lower voltage supply, such as 1.8 volts, and yet have sufficient headroom for operation of low drop-out regulator 700.

Current source device 726 is configured to drive a plurality of current sources 716, 718, 626 and 628. Current source device 726 can include various types and configurations of current source devices for driving a plurality of current sources. To facilitate the driving of current sources 716, 718, 626 and 628, error amplifier 702 can include a diode-connected transistor device 714 configured to mirror current from current source device 726 to current sources 716, 718, 626 and 628. As explained above with respect to current feedback amplifier 600, due to the operation of current sources 626 and 628, error amplifier 702 is not required to drive a large amount of current to operate current feedback amplifier 706.

Current feedback amplifier 706 is configured to operate with low current from error amplifier 702 and to suitably drive the gate of pass device 704. In the exemplary embodiment, current feedback amplifier 406 includes an amplifier similar to that of current feedback amplifier 600. However, current feedback amplifier 706 can also be configured in various other circuit arrangements configured for driving pass device 704. In this exemplary embodiment, input device 602 has a source coupled through input terminal $V_{PP}(+)$ to output terminal $V_{OUT}$ and to pass device 704, while input device 604 has a source coupled through input terminal $V_{NN}(-)$ to output device 724 of error amplifier 702.

Pass device 704 comprises a power transistor device configured for driving an output current $I_{OUT}$ to a load device. In the exemplary embodiment, pass device 704 includes a PMOS transistor device having a source coupled to a supply voltage rail $V_S$, and a drain coupled to a output voltage terminal $V_{OUT}$. However, pass device can include any power transistor configuration for driving output current $I_{OUT}$ to a load device. In addition, pass device 704 is configured to source as much current as needed by the load device and/or divider network 708.

Divider network 708 suitably comprises a resistive divider configured for providing a composite feedback signal. In the exemplary embodiment, divider network 708 includes a pair of resistors $R_{D1}$ and $R_{D2}$. However, divider network 708 can include any configuration of resistors for providing a voltage divider operation. Resistor $R_{D1}$ is coupled between pass device 704 and resistor $R_{D2}$, while resistor $R_{D2}$ is connected to ground. A composite feedback signal can be provided from a node $V_{FDBK}$ configured between resistors $R_{D1}$ and $R_{D2}$, to the negative input terminal of error amplifier 702, i.e., to the gate of input transistor 710.

In the exemplary embodiment, the positive input terminal of current feedback amplifier 706, i.e., the source of input transistor 602, is coupled in a feedback arrangement to the output terminal $V_{OUT}$ and to the drain of pass device 704. In addition, diode-connected devices 606 and 608 are configured to control input devices 602 and 604 such that any current signals appearing at input terminals $V_{PP}(+)$ and $V_{NN}(-)$ will flow through input devices 602 and 604, respectively.

During operation of low drop-out regulator 700, for example when the output voltage at terminal $V_{OUT}$ increases rapidly, such as when an output load is turned off rapidly to release the output voltage upwards, current amplifier 706 operates to drive node $V_{GATE}$ of pass device 704 to the upper rail supply $V_S$.

Since the load current is significantly reduced, pass device 704 will suitably drive a higher current into input device 602 through input terminal $V_{PP}(+)$. The higher current flowing through input device 602 can be suitably mirrored through current mirror 610 to upper rail device 622, turning on output device 624, pulling up node $V_{GATE}$ very rapidly towards supply rail $V_S$.

Node 632 tracks the rise in $V_{PP}(+)$, since the gate-source voltage $V_{GS}$ of device 608 remains fixed. The gate-source voltage $V_{GS}$ of device 604 decreases, effectively shutting off lower output device 620, releasing node $V_{GATE}$ to rise even closer to the upper supply rail $V_S$.

At the same time, the rising voltage at terminal $V_{OUT}$ is divided down by $R_{D1}$ and $R_{D2}$. The $V_{FDBK}$ node also rises, causing the output device 724 of error amplifier 702 to shut off rapidly, thus causing the voltage at input terminal $V_{NN}(-)$ to decrease. The current driven through input device 604 is further reduced, releasing node $V_{GATE}$ to rise even closer to the upper supply rail $V_S$.

Node 630 tracks the decrease in $V_{NN}(-)$, since the gate-source voltage $V_{GS}$ of device 606 remains fixed. The gate-source voltage $V_{GS}$ of device 602 increases, further increasing the current through device 602, which is suitably mirrored through current mirror 610 to the upper rail device 622, further turning on output device 624 to pull up the gate of pass device 704.

On the other hand, when the output voltage at terminal $V_{OUT}$ decreases rapidly, such as when an output load is turned on rapidly to pull the output voltage downwards, current amplifier 706 operates to drive node $V_{GATE}$ of pass device 704 to ground.

Since the load current is significantly increased, pass device 704 will suitably drive a lower current into input device 602 through input terminal $V_{PP}(+)$. The lower current flowing through input device 602 can be suitably mirrored through current mirror 610 to upper rail device 622, effectively turning off output device 624, releasing node $V_{GATE}$ to fall to ground.

Node 632 tracks the fall in $V_{PP}(+)$, since the gate-source voltage $V_{gs}$ of device 608 remains fixed. The gate-source voltage $V_{GS}$ of device 604 increases, turning on lower output device 620, pulling down node $V_{GATE}$ very rapidly towards ground.

At the same time, the decreasing voltage at terminal $V_{OUT}$ is divided down by $R_{D1}$ and $R_{D2}$. The $V_{FDBK}$ node also decreases, causing the output device 724 of error amplifier 702 to turn on rapidly, causing the voltage at input terminal $V_{NN}(-)$ to increase. the current driven through input device 604 is further increased, pulling down node $V_{GATE}$ even closer to ground.

Node 630 tracks the increase in $V_{NN}(-)$, since the gate-source voltage $V_{GS}$ of device 606 remains fixed. The gate-source voltage $V_{GS}$ of device 602 decreases, further decreasing the current through device 602, which is suitably mirrored through current mirror 610 to the upper rail device 622, further turning off output device 624, thus releasing node $V_{GATE}$ to fall to even closer to ground.

As a result, the high current provided to the gate of pass device 704 suitably enables any parasitic capacitances within pass device 704 to be rapidly charged and discharged without impairing the operation of error amplifier 702 and current feedback amplifier 706. In addition, the gate of pass device 704 can be suitably driven to the upper rail and ground, i.e., rail-to-rail, with the current supplied by current feedback amplifier 706. Accordingly, current feedback amplifier 706 can suitably utilize current, rather than voltage, to charge and discharge the parasitic capacitances very rapidly. In other words, current feedback amplifier 706 can suitably receive an input current, convert that current into a voltage, and then convert the voltage back to a current for output to drive the pass device.

Moreover, current feedback amplifier 706 does not require a high input voltage or high input current for operation. Instead, a low voltage less than 2 times the threshold voltage $V_T$, can be provided to error amplifier 702 and current feedback amplifier 706. In addition, current feedback amplifier 706 can operate with only a few micro-amps of current, and yet can provide several milli-amps of output current very quickly to drive the gate of pass device 704.

In accordance with another aspect of the present invention, the gain of low drop-out regulator 700 can be relegated to error amplifier 702, which also controls the offset, and which does not need to drive a high amount of current to current feedback amplifier 706. In accordance with this aspect of the present invention, the matching of the various transistor devices of current feedback amplifier 706, such as devices 602, 604, 606, 608, 612, 614, 618, 620, 622 and 624, and error amplifier 702, such as devices 710 and 712, is not critical to the operation of low drop-out regulator 700. The composite feedback configuration of error amplifier 702, which is configured to control the offset of low drop-out regulator 700, does not significantly affect the accuracy of the output of current feedback amplifier 706. In addition, the gain of low drop-out regulator 700 is controlled by error amplifier 702, i.e., current feedback amplifier 706 does not need to control the gain, and thus compensation does not need to be provided from current feedback amplifier 706. Accordingly, transistor devices 710 and 712 can comprise 10× devices, while devices 602 and 604 (4×), devices 606 and 608 (2×), and devices 612 and 614 (1×) can include different sized devices without impacting the offset of low drop-out regulator 700.

The present invention has been described above with reference to various exemplary embodiments. However, those skilled in the art will recognize that changes and modifications may be made to the exemplary embodiments without departing from the scope of the present invention. For example, the various components may be implemented in alternate ways, such as, for example, by implementing BJT devices for the various devices. Further, the various exemplary embodiments can be implemented with other types of power supply circuits in addition to the circuits illustrated above. These alternatives can be suitably selected depending upon the particular application or in consideration of any number of factors associated with the operation of the system. Moreover, these and other changes or modifications are intended to be included within the scope of the present invention, as expressed in the following claims.

What is claimed is:

1. A low drop-out regulator configured for providing output current to a load device, said low drop-out regulator comprising:

an error amplifier configured to control the gain of said low drop-out regulator, said error amplifier having a positive input terminal configured for receiving a reference voltage, and a negative input terminal configured for receiving a composite feedback signal within a composite feedback loop;

a current feedback amplifier having a negative input terminal coupled to an output of said error amplifier, and a positive input terminal configured for receiving a feedback signal within a local feedback loop, said local feedback loop being decoupled from said composite feedback loop of said error amplifier; and a pass device configured for driving a downstream device, said pass device comprising a power transistor configured driving a load current to the downstream device, said pass device having a control terminal coupled to an output of said current feedback amplifier, and wherein said feedback signal within said local feedback loop comprises an output signal of said pass device, said output signal of said pass device being further configured for generating said composite feedback signal.

2. The low drop-out regulator according to claim 1, wherein said low drop-out regulator further comprises a divider network configured for receiving said output signal of said pass device, and configured for generating said composite feedback signal and providing said composite feedback signal through a resistance device to said negative input terminal of said error amplifier.

3. The low drop-out regulator according to claim 1, wherein said error amplifier comprises a class A output configuration for providing a low current from said error amplifier to said current feedback amplifier.

4. The low drop-out regulator according to claim 1, wherein said error amplifier further comprises a capacitor coupled between said output of said error amplifier and said negative input terminal of said error amplifier, said capacitor configured for supplying current to said current feedback amplifier for driving said pass device.

5. The low drop-out regulator according to claim 1, wherein said error amplifier comprises:

a differential pair of transistors;

a current mirror circuit configured for mirroring current from a drain of one of said differential pair of transistors; and an output transistor having a control terminal configured for receiving said current mirrored from said current mirror circuit and current from an output of another of said differential pair of transistors.

6. The low drop-out regulator according to claim 1, wherein said current feedback amplifier is configured for facilitating rail-to-rail operation of said control terminal of said pass device, said current feedback amplifier comprising:

a pair of input transistors, with a first input transistor having an input terminal configured for receiving said feedback signal within said local feedback loop, and a second input transistor having an input terminal configured for receiving a low current from said error amplifier;

a pair of diode-connected devices configured to control a flow of current within said pair of input transistors, with a first diode-connected device having a control terminal connected to a control terminal of said first input transistor, and a second diode-connected device having a control terminal connected to a control terminal of said second input transistor;

a pair of current mirrors configured to mirror said flow of current with said pair of input transistors, with a first current mirror coupled to an output terminal of said first input transistor, and a second current mirror coupled to an output terminal of said second input transistor; and a pair of upper rail transistors configured for providing said high output current to said pass device, said pair of upper rail transistors comprising a first upper rail transistor configured for mirroring current from said first current mirror to a second upper rail transistor comprising an output device for said current feedback amplifier configured for providing said high output current.

7. The low drop-out regulator according to claim 6, wherein said current feedback amplifier further comprises:

a first current source coupled to an output terminal of said first diode-connected device and being configured to provide a fixed current flowing through said first diode connected device; and a second current source coupled to an output terminal of said second diode-connected device, said second current source being configured to provide a fixed current flowing through said second diode connected device.

8. The low drop-out regulator according to claim 6, wherein said current feedback amplifier is configured to provide rail-to-rail operation by turning on said first input transistor and turning off said second input transistor to drive said control terminal of said pass device to an upper rail, and by turning off said first input transistor and turning on said second input transistor to drive said control terminal of said pass device to ground.

9. The low drop-out regulator according to claim 6, wherein said pair of input transistors are approximately twice the size of said pair of diode-connected devices.

10. The low drop-out regulator according to claim 6, wherein said output device of said current feedback amplifier is approximately four times the size of said first upper rail transistor.

11. A digital signal processor having a low drop-out regulator configured for providing output current to a load device, said low drop-out regulator comprising:

an error amplifier having a non-inverting input terminal configured for receiving a reference voltage and an inverting input terminal configured for receiving a composite feedback signal, and providing an output current;

a current feedback amplifier configured for receiving said output current from said error amplifier and for providing an output current, said current feedback amplifier having an inverting input terminal coupled to said error amplifier, and a non-inverting input terminal for receiving a feedback signal; and a pass device configured for providing an output signal to an output load, said pass device comprising a power transistor having a control terminal configured to be driven by said output current from said current feedback amplifier, and wherein said output signal of said pass device is configured to provide a said feedback signal to said current feedback amplifier within a current feedback loop, said output signal of said pass device being further configured for generating said composite feedback signal to said error amplifier to provide a composite feedback loop, said current feedback loop being decoupled from said composite feedback loop of said error amplifier.

12. The digital signal processor according to claim 11, said error amplifier being configured in a class A output configuration.

13. The digital signal processor according to claim 11, wherein said low drop-out regulator further comprises a divider network configured for receiving said output signal of said pass device, and configured for generating said composite feedback signal and for providing said composite feedback signal through a resistance device to said inverting input terminal of said error amplifier.

14. The digital signal processor according to claim 11, wherein said error amplifier further comprises a capacitor coupled between an output terminal of said error amplifier and said inverting input terminal of said error amplifier, said capacitor configured for supplying current to said current feedback amplifier for driving said pass device.

15. The digital signal processor according to claim 11, wherein said error amplifier comprises:

a differential pair of transistors;

a current mirror circuit configured for mirroring current from an output terminal of one of said differential pair of transistors; and an output transistor having a control terminal configured for receiving said current mirrored from said current mirror circuit and current from an output terminal of another of said differential pair of transistors.

16. The digital signal processor according to claim 11, wherein said current feedback amplifier is configured for facilitating rail-to-rail operation of a control terminal of said pass device, said current feedback amplifier comprising:

a pair of input transistors, with a first input transistor having an input terminal configured for receiving said feedback signal within said current feedback loop, and a second input transistor having an input terminal configured for receiving said low output current from said error amplifier;

a pair of diode-connected devices configured to control a flow of current within said pair of input transistors, with a first diode-connected device having a control terminal connected to a control terminal of said first input transistor, and a second diode-connected device having a control terminal connected to a control terminal of said second input transistor;

a pair of current mirrors configured to mirror output current from said pair of input transistors, with a first current mirror coupled to an output terminal of said first input transistor, and a second current mirror coupled to an output terminal of said second input transistor; and a pair of upper rail transistors configured for providing said high output current to said pass device, said pair of upper rail transistors comprising a first upper rail transistor configured for providing current from said first current mirror to a second upper rail transistor comprising an output device configured for providing said high output current for driving said control terminal of said pass device.

17. The digital signal processor according to claim 16, wherein said current feedback amplifier further comprises:

a first current source coupled to an output terminal of said first diode-connected device and being configured to provide a fixed current flowing through said first diode connected device; and a second current source coupled to an output terminal of said second diode-connected device, said second current source being configured to provide a fixed current flowing through said second diode connected device.

18. The digital signal processor according to claim 16, wherein said current feedback amplifier is configured to provide rail-to-rail operation by turning on said first input transistor and turning off said second input transistor to drive said control terminal of said pass device to an upper rail.

19. The digital signal processor according to claim 16, wherein said current feedback amplifier is configured to provide rail-to-rail operation by turning off said first input transistor and turning on said second input transistor to drive said control terminal of said pass device to ground.

20. The digital signal processor according to claim 16, wherein said pair of input transistors are approximately twice the size of said pair of diode-connected devices.

21. The digital signal processor according to claim 16, wherein said output device of said current feedback amplifier is approximately four times the size of said first upper rail transistor.

22. A low drop-out regulator comprising:

an error amplifier having a non-inverting input terminal configured for receiving a reference voltage and an inverting input terminal configured for receiving a composite feedback signal through a resistance device within a composite feedback loop, said error amplifier being configured for providing an output current;

a current feedback amplifier configured for receiving said output current from said error amplifier, for converting said output current to a voltage signal, and for converting said voltage signal back to provide an output current, said current feedback amplifier having an inverting input terminal coupled to said error amplifier, and a non-inverting input terminal for receiving a feedback signal within a current feedback loop;

a pass device comprising a power transistor having a control terminal configured to be driven by said output current from said current feedback amplifier, said power transistor having an output terminal configured for providing an output signal, said output signal comprising said feedback signal received by said current feedback amplifier; and a divider network configured for receiving said output signal of said pass device, said divider network comprising a plurality of resistors configured for generating said composite feedback signal; and wherein said current feedback loop is decoupled from said composite feedback loop of said error amplifier.

23. The low drop-out regulator according to claim 22, wherein said error amplifier further comprises a capacitor coupled between an output terminal of said error amplifier and said inverting input terminal of said error amplifier, said capacitor configured for supplying current to said current feedback amplifier for driving said pass device.

24. The low drop-out regulator according to claim 22, wherein said current feedback amplifier is further configured for facilitating rail-to-rail operation of a gate of said pass device, said current feedback amplifier comprising:

a pair of input transistors, with a first input transistor having an input terminal configured for receiving said feedback signal within said current feedback loop, and a second input transistor having an input terminal configured for receiving said low output current from said error amplifier;

a pair of diode-connected devices configured to control a flow of current within said pair of input transistors, with a first diode-connected device having a control terminal connected to a control terminal of said first input transistor, and a second diode-connected device having a control terminal connected to a control terminal of said second input transistor;

a pair of current mirrors configured to mirror output current from said pair of input transistors, with a first current mirror coupled to an output terminal of said first input transistor, and a second current mirror coupled to an output terminal of said second input transistor; and a pair of upper rail transistors configured for providing said high output current to said pass device, said pair of upper rail transistors comprising a first upper rail transistor configured for providing current from said first current mirror to a second upper rail transistor comprising an output device configured for providing said high output current for driving said control terminal of said pass device.

25. The low drop-out regulator according to claim 24, wherein said current feedback amplifier further comprises:

a first current source coupled to an output terminal of said first diode-connected device and being configured to provide a fixed current flowing through said first diode connected device; and a second current source coupled to an output terminal of said second diode-connected device, said second current source being configured to provide a fixed current flowing through said second diode connected device.

26. A low drop-out regulator comprising:

an error amplifier configured for receiving a composite feedback signal within a composite feedback loop, and for providing an output current;

a current feedback buffer configured for receiving said output current from said error amplifier, for providing a high output current, and for receiving a feedback signal within a current feedback loop, said current feedback loop being decoupled from said composite feedback loop of said error amplifier; and a pass device having a control terminal configured to be driven by said high output current from said current feedback buffer, said pass device configured for providing an output signal that provides said feedback signal received by said current feedback buffer, wherein said error amplifier is configured in a class A output configuration.

27. The low drop-out regulator according to claim 26, said low drop-out regulator further comprising a divider network configured for receiving said output signal of said pass device, and for generating said composite feedback signal.

* * * * *